United States Patent [19]

Akhagen et al.

[11] 4,026,189

[45] May 31, 1977

[54] PROJECTILE LOCKING DEVICE

[75] Inventors: Rune Verner Akhagen, Eskilstuna; Claes Gustav Erik Yngve Tisell, Strangnas; Anders Hakan Andersson, Eskilstuna, all of Sweden

[73] Assignee: Forenade Fabriksverken, Eskilstuna, Sweden

[22] Filed: Feb. 18, 1976

[21] Appl. No.: 659,158

[30] Foreign Application Priority Data

Feb. 20, 1975 Sweden ..... 7501893

[52] U.S. Cl. ..... 89/1.703; 89/1.806

[51] Int. Cl.[2] ..... F41F 3/02

[58] Field of Search ..... 89/1.703, 1.7, 1.704, 89/1.806

[56] References Cited

UNITED STATES PATENTS

| | | | |
|---|---|---|---|
| 3,376,784 | 4/1968 | Abramson | 89/1.703 |
| 3,380,340 | 4/1968 | Bergman et al. | 89/1.703 |
| 3,444,773 | 5/1969 | Ligne | 89/1.806 X |
| 3,490,330 | 1/1970 | Walther | 89/1.703 X |
| 3,677,131 | 7/1972 | Nee | 89/1.703 |

*Primary Examiner*—David H. Brown

*Attorney, Agent, or Firm*—Fleit & Jacobson

[57] ABSTRACT

The invention provides a projectile locking device for a recoilless weapon whereby the projectile is positively locked in a position within the barrel of the weapon so that the projectile cannot be displaced therefrom, for example, in the event that the weapon is dropped accidentally. Previously known devices can cause significant disturbance of the gas flow, causing inbalance of the forwardly and rearwardly directed forces during a firing sequence. The present invention provides a locking device which is of small dimension relative to prior devices so that less disturbance of the gas flow is caused. The invention provides an assembly of a breakable rigid member and a resilient member, one end of which is connected to the projectile and the other end being connected to a holding device in turn connected to the weapon barrel. The arrangement is such that the rigid member is broken only when the projectile has moved a set distance in the barrel under the influence of propelling gases and against the action of the resilient member. Preferably the resilient member comprises a set of plate springs having a control bore through which the rigid member (preferably a metallic pin) passes.

7 Claims, 3 Drawing Figures

PROJECTILE LOCKING DEVICE

The present invention relates to a device for locking a projectile in a recoilless weapon. In the case of recoilless weapons, such as anti-tank rifles, it is constantly necessary to lock the projectile mechanically in the weapon, (the rifle) so that it can be handled in the field without risk of the projectile falling from the barrel of the weapon unintentionally. Thus, the weapon must be reliable in this respect when handled, the degree of this reliability being defined by the fact that the weapon shall be able to fall from a height of some meters and to strike a solid surface at different angles of impact without the projectile being loosened therewith. Such mechanical locking is particularly necessary in the case of weapons having smooth barrels and weapons in which the continued resistance to movement of the projectile in the barrel is low. The projectile can be locked through the casing of the projectile or through the barrel or through the part of the projectile propelling system which remains in the barrel subsequent to the weapon being fired.

With recoilless weapons it is attempted, from the aspect of internal ballistics, to obtain a balance between the forwardly directed and rearwardly directed forces during a firing sequence. This means that during the time taken for the pressure to be built up in the barrel of the weapon as a result of the combustion of the propellant, and before the projectile and propellant gases leave the barrel, it is desired at each moment of time to obtain the greatest possible balance between the forwardly and rearwardly directed forces which act upon the weapon. In order to obtain this equilibrium, there is utilized a balanced portion of the gas generated during the combustion of the propellant, this portion of the gas being permitted to leave the weapon rearwardly through a nozzle the area of the orifice of which is adjusted substantially in accordance with the calibre of weapon. The gas is then caused to pass through a diffuser. By suitable design of the nozzle and the diffuser a balance between the forces can be obtained when seen totally for the whole of the aforementioned time sequence.

When, however, the gas flow in the forward or rearward direction is impeded differently during a minor portion of said time sequence than during the major portion thereof, there will be no balance during this portion of the time sequence. Consequently, as a rule the nozzle and the diffuser must be so designed that such an imbalance is compensated during the major portion of said time sequence, thereby to obtain a balanced system as seen totally for the whole of the time sequence. The disadvantages with this can generally be overcome on the part of the marksman, but are accentuated with light weapons. The imbalance occurs for a short period of time (in practice for some tenths of a microsecond) but results in measurable movement of the barrel during the time required for the marksman to sight his weapon onto the target.

As previously mentioned this phenomenon of imbalance is a result of brief disturbances in the equilibrium of gas flow. One reason for this is the mechanical locking of the projectile, which must be undertaken so that the weapon can be reliably handled. A locking device dimensioned so as to satisfy the aforementioned handling requirements can cause the pressure prevailing when a shot is fired to reach 10—50 atm. in order that the breakable connector between the weapon and the projectile is broken. In the case of low-pressure weapons (having a maximum pressure of between 100 and 500 atm.) this means that a substantial portion of the recoil sequence (the forward recoil) is unimpeded and must be compensated during the subsequent time period. It is therefore important that the breakable connector is not made stronger than necessary.

The object of the present invention is to provide a device for locking a projectile in a recoilless weapon, which device is favourable from the handling aspect, whilst at the same time providing a minimum of imbalance during a firing sequence.

According to the invention there is provided a projectile locking device for recoilless weapon in the form of a breakable connector comprising a breakable rigid member and a resilient member assembled together in series, one end of said assembly being for connection to the rear end of the projectile, and the other end being for connection to a holding device, the holding device being arranged to be connected to the barrel of the weapon either directly or indirectly, and the breakable rigid member being adapted, in use, to be broken only when the projectile, under the influence of the propelling gases and against the action of the resilient member, has moved a pre-determined distance from its rest position in the barrel of the weapon and towards the muzzle thereof.

Said predetermined or retardation distance is that distance which the projectile can move axially along the barrel whilst still connected to the breakable connector.

In a particularly suitable embodiment of device according to the invention, the resilient member is arranged to have a pre-tension which is lower than that which, from the internal ballistic aspect, corresponds to an acceptably low pressure level, preferably lower than 1 atm. overpressure.

The resilient member may comprise a spring, or a set of springs of different type, or a homogeneous resilient material arranged for mounting co-axially with the projectile and the barrel.

The rigid member may comprise different elements having different configurations which elements break or loosen and which have a relatively low degree of elasticity.

The invention is described in detail in the following with reference to the accompanying drawings in which.

Figure 1:
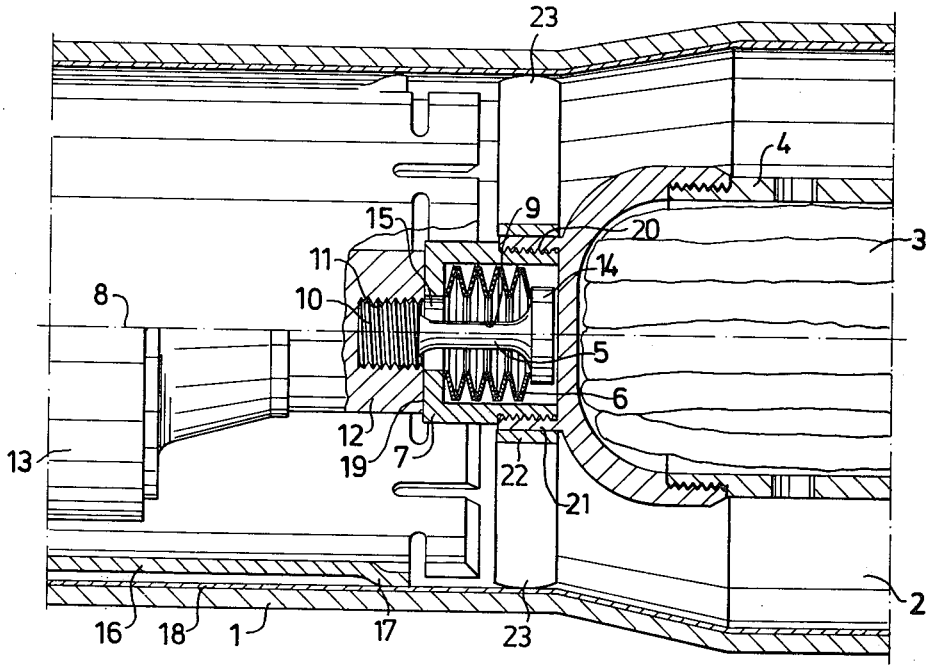
FIG. 1 shows an axial sectional view through one embodiment of the portion of a recoilless weapon incorporating the locking device according to the invention.

Referring to FIG. 1 of the drawings, the muzzle of the weapon lies to the left of the FIG. 1 and its propulsion portion to the right thereof. The main part of the weapon comprise a barrel 1 and a propulsion portion 2 having a breach 3 which is delimited by a casing 4. The propulsion portion 2 is preferably rigidly connected in a known manner with the rear portion of the barrel 1. In the embodiment of FIG. 1, there is fixedly arranged on the propulsion portion 2, a projectile locking device which includes a breakable connector and comprising a rigid pin 5 of suitable metal and a set of plate springs 6. The set of springs 6 is arranged in a spring housing 7 coaxial with the access 8 of the barrel 1. The body of the pin 5 passes through a central bore 9 in the set of springs 6 and has a certain play with respect to said set of springs so that the pin has a certain degree of movement laterally relative to the set of springs. Arranged on one end of the pin 5 is a head 10 which is screwed into a threaded hole 11 in a projectile attachment 12 seated on the end of the projectile 13. Arranged on the other end of the pin is a flange 14 against one face of which one end of the set of springs 6 bears. The other end of the set of springs 6 abuts the edge of an opening 15 in the spring housing 7 through which the pin 5 extends into the housing.

The projectile 13 is surrounded by a guide tube 16 having guide tube supports 17 which rest against the lining 18 of the barrel. To enable the projectile to be inserted into the barrel, a certain clearance is required between the supports 17 and the lining 18, which in turn means that the projectile attachment 12 has a certain degree of movement laterally with respect to the spring housing 7. The contact surface 19 between the projectile attachment and the spring housing 7 thus acts to a certain extent as a slide surface between these two parts; the pin has a certain clearance in the bore 9 of the spring set as beforementioned, so that the pin 5 is not subjected to breaking strains during lateral movement of the pin.

Through a thread joint 20, the spring housing 7 is rigidly connected with a collar 21, arranged on the forward end of the propulsion portion 2. At its forward end, the propulsion portion 2 is supported by a supporting cross-like member comprising a circular flange 22, which abuts the outer surface of the collar 21, and a plurality of radially extending flanges 23, which extend into abutment with the lining 18 of the barrel.

Figure 2:
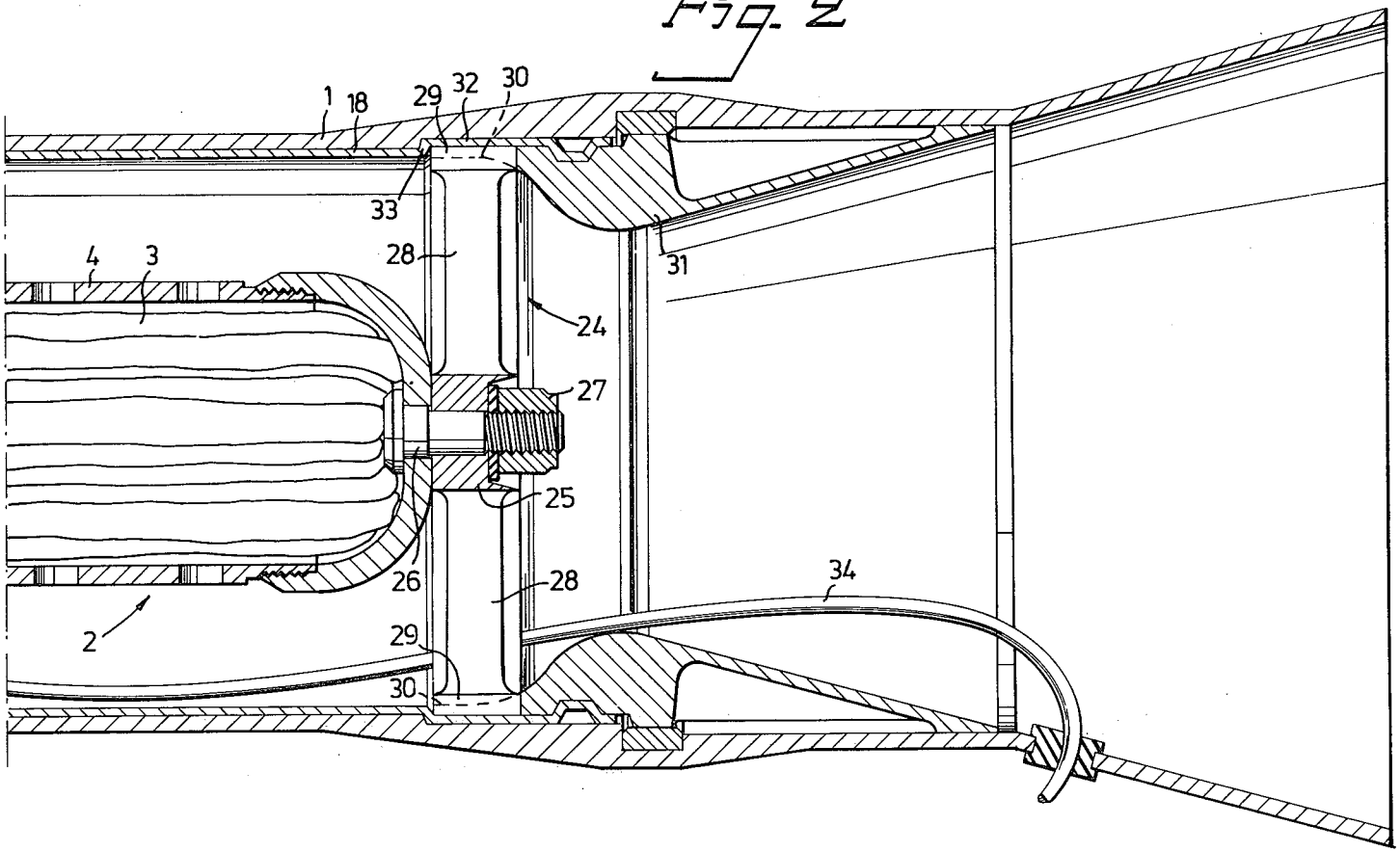
FIG. 2 is an axial sectional view showing how the propulsion portion of the weapon is fixed therein.

In a conventional manner, the rear end of the propulsion portion 2 is rigidly connected with the barrel, as more clearly shown in FIG. 2.

In FIG. 2, the propulsion portion 2 is rigidly connected to the barrel 1 through a rearward supporting cross-like member 24. The member 24 comprises a cylindrical hub 25 to which said propulsion portion 2 is connected by means of a screw 26 and a nut 27. The hub 25 has four radially extending arms 28, of which two are shown in FIG. 2. The ends of the flanges 28 are widened to form shoes 29, each of which is passed through a respective slot 30 in a nozzle wall 31, which latter is rigidly connected to the rearward portion of the weapon, said shoes being so arranged in said slots that they abut a recessed portion 32 of the barrel lining 18. The width and length of the slots 30 are of the same dimensions as those of the shoes 29 whereby the side and bottom surfaces of a slot abut a respective shoe. Thus, the supporting cross-like member 24 is unable to rotate in the barrel, or move rearwardly therein. In addition, the forward edge 33 of the recess 32 prevents the supporting cross-like member from moving forwardly in the barrel. The fixing of the supporting cross-like member 24 to the barrel can be strengthened by welding the shoes 29 to the edges of the slots 30, or to the barrel lining 18.

The propulsion portion 2 is provided, in a conventional manner, with a firing cable 34, which is arranged to be actuated by a propellant ignition device (not shown) arranged in the propulsion portion 2.

As will be readily perceived, the supporting cross-like member 24 may have a form different from that shown in FIG. 2. For example, the shoes 29 may have the form of a ring which abuts, completely around its periphery, with the barrel lining 18 and is secured thereto in some suitable manner.

Alternatively, the supporting cross-like member 24 may be resiliently connected with the barrel wall.

A thus constructed breakable connector, which may be constructed in the manner illustrated in FIG. 1, has the following mode of operation, when the set of springs 6 is subjected to a load, which set of springs is pre-tensioned to a low pressure by means of the pin 5 (corresponding to less than 1 atm. pressure in the breach 3), the set of springs is compressed so as to brake gently movement of the projectile 13 during an adjusted compression. When the set of springs 6 is substantially fully compressed, the rigid pin 5 has reached its breaking point and the projectile 13 is released. This is clearly an advantage from the handling aspect since, if the weapon with a projectile in the barrel thereof is dropped against a solid surface, the projectile is permitted an axial movement in the barrel, such movement being controlled by the set of springs 6. In this way, the pin 5 is less liable to break as a result of such impact. Since such movement of the projectile in the barrel is thus permitted, and since the impact force is initially taken up by the springs, the pin can be of smaller diameter than otherwise. The construction also permits lateral movability of the projectile 13, which is favourable from the handling aspect. The pressure at which the pin 5 breaks can be half or a third of the normal breaking pressure even with quite moderate retardation distances (compression distances) owing to the incorporation of the set of springs 6. From the internal ballistic aspect, this lowering of the discharge pressure of the projectile affords considerable gain with respect to the recoil balance. In addition, the advantage is afforded whereby even though the resilient portion of the breakable connector may impede the acceleration of the projectile it nevertheless permits a relatively well-balanced gas flow right from the beginning of a firing sequence compared with the obstruction which a rigidly locked projectile represents to the total gas flow. The described breakable connector thus affords considerably improved possibilities of obtaining a balance during the separate parts of a firing sequence.

Figure 3:
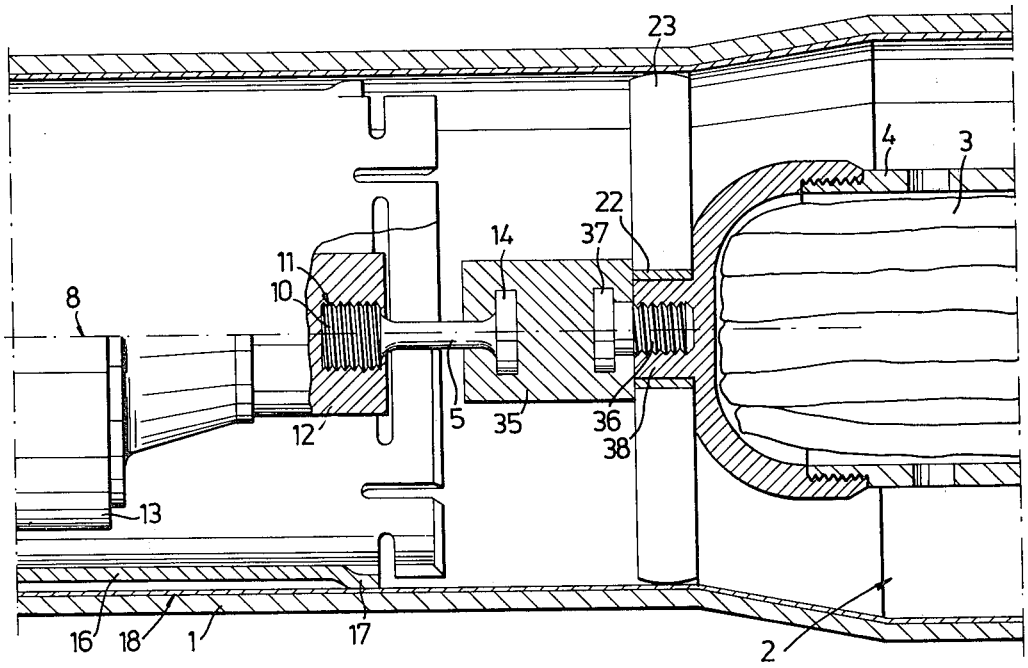
FIG. 3 is a view similar to that of FIG. 1 of another embodiment.

In accordance with another embodiment as shown in FIG. 3, the spring housing 7 enclosing the set of springs 6 of the FIG. 1 embodiment, is replaced by a cylinder 35 comprising a homogeneous plug of resilient material such as rubber. In this embodiment the flange 14 of the pin 5 is rigidly attached to the cylinder 35. A connector 36, whose head 37 is rigidly attached to the cylinder 35, is screwed into an axial projection 38 on the propulsion portion 2. With this embodiment, the resilient member 35 is subjected to tension instead of compression when a projectile is fired. Since the function of the cylinder 35 is equivalent to that of the FIG. 1 embodiment, viz., for use in combination with a breakable rigid connector, no further description is necessary.

This invention is not restricted to the described and illustrated embodiments, but can be modified within the scope of the following claims.

We claim:

1. A projectile locking device for a recoilless weapon having a barrel for housing a projectile therein and a muzzle on the barrel comprising, in combination, a breakable connector for connecting the projectile to the weapon barrel, said breakable connector including a holding device, means for connecting said holding device to the weapon barrel, a breakable rigid member, a resilient member, means including said holding device for interconnecting said breakable rigid member and said resilient member in series to form an assembly, said assembly having one end connected to the rear end of the projectile and having the other end connected to said holding device to retain the projectile in a rest position within the weapon barrel, said breakable rigid member being formed of a material for permitting said rigid member to break only when the projectile is subjected to the force of the propelling gases in the weapon and has moved a predetermined distance from said rest position towards the weapon muzzle against the action of said resilient member.

2. A locking device according to claim 1 wherein said resilient member in said projectile rest position is pretensioned at a level which from a handling and an internal ballistic aspect corresponds to an acceptably low pressure level approximately lower than 1 atm. overpressure.

3. A locking device according to claim 1 wherein said rigid member comprises a metallic pin.

4. A locking device according to claim 1 wherein the weapon includes a propulsion portion and wherein said holding device connecting means arranged to connect said holding device to the barrel through the weapon propulsion portion.

5. A locking device according to claim 1 wherein said resilient member comprises a spring.

6. A locking device according to claim 5 wherein said resilient member comprises a set of compressible plate springs, each defining a central bore, and wherein said rigid member passes through said bore in coaxial relationship with the barrel, said rigid member having one end bearing against one end of said set of springs.

7. A locking device according to claim 6 wherein said rigid member is arranged for lateral movement with respect to said set of springs to a degree greater than the play normally provided between the guide surface of the projectile and the barrel whereby, during handling of the weapon, the breakable connector is not subjected to breaking stresses upon lateral movement of said rigid member.

* * * * *